US005288691A

United States Patent [19]

Vanier et al.

[11] Patent Number: 5,288,691

[45] Date of Patent: Feb. 22, 1994

[54] STABILIZERS FOR DYE-DONOR ELEMENT USED IN THERMAL DYE TRANSFER

[75] Inventors: Noel R. Vanier, Fort Collins, Colo.; Michel F. Molaire, Rochester, N.Y.; Csaba A. Kovacs, Rochester, N.Y.; Paul D. Yacobucci, Rochester, N.Y.

[73] Assignee: Eastman Kodak Company, Rochester, N.Y.

[21] Appl. No.: 83,836

[22] Filed: Jun. 28, 1993

Related U.S. Application Data

[63] Continuation-in-part of Ser. No. 21,381, Feb. 23, 1993.

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,449,165 2/1985 Molaire ..... 430/17

4,855,281 8/1989 Byers ..... 503/227

*Primary Examiner*—B. Hamilton Hess

*Attorney, Agent, or Firm*—Harold E. Cole

[57] ABSTRACT

This invention relates to a dye-donor element for thermal dye transfer comprising a support having thereon a dye layer comprising an image dye in a polymeric binder, and wherein the dye layer also contains a stabilizer comprising a monomeric or oligomeric organic material having a glass transition temperature of greater than about 60° C., the stabilizer:

a) being derived from a mixture of at least two different compounds, each having at least two linking components joining one multivalent organic nucleus with at least two organic nuclei, wherein at least one of the multivalent organic nucleus and the organic nuclei is a multicyclic aromatic nucleus; or b) having a phenylindane moiety.

20 Claims, No Drawings

STABILIZERS FOR DYE-DONOR ELEMENT USED IN THERMAL DYE TRANSFER

This application is a continuation-in-part of U.S. Ser. No. 08/021,381, filed Feb. 23, 1993.

This invention relates to the use of certain monomeric glass stabilizers in dye-donor elements for thermal dye transfer systems.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

An important requirement for any thermal dye-donor element is to maintain performance over its useful lifetime without degradation in the quality of the image. The dye layer of a dye-donor element for resistive head thermal dye transfer generally comprises a polymeric binder and diffusible dyes. The percentage of dye in the layer is typically quite high, in the range of 20 to 80%. The dye is usually dissolved in the binder or phase-separated into small domains. During keeping of the donor, the temperature and humidity may be elevated and the dye layer is in contact with a slipping layer coated on the back side of the donor element when it is wound up in spool form. The slipping layer may contain mobile lubricating oils or materials which can act as plasticizers or solvents for the dye layer. This enables the dye to become mobile, allowing changes to occur in the layer including further phase separation, migration of the dye to the surface, and even crystallization of the dye. Dye may also transfer to the slipping layer. These changes generally result in sensitometric variations, nonuniform printing due to light or dark spots and dye smearing from a high density to a low density area of the print.

U.S. Pat. No. 4,499,165 relates to an amorphous mixture of compounds useful as a binder in optical recording elements. There is no disclosure in this patent that such materials would be useful as a stabilizer in thermal dye transfer elements.

U.S. Ser. No. 890,456 of Neumann, filed May 29, 1992, relates to the use of nonpolymeric, organic materials as a binder for laser-induced thermal dye transfer elements. There is no disclosure in that application, however, that such materials would be useful as a stabilizer in a dye-donor element which contains a polymeric binder for the dye and which is used in resistive head printing.

It is an object of this invention to provide a stabilizer for a dye-donor element for resistive head printing to inhibit dye crystallization. It is another object of this invention to provide a stabilizer for a dye-donor element for resistive head printing to minimize sensitometric changes upon keeping.

These and other objects are achieved in accordance with this invention which relates to a dye-donor element for thermal dye transfer comprising a support having thereon a dye layer comprising an image dye in a polymeric binder, and wherein the dye layer also contains a stabilizer comprising a monomeric or oligomeric organic material having a glass transition temperature of greater than about 60° C., the stabilizer:

a) being derived from a mixture of at least two different compounds, each having at least two linking components joining one multivalent organic nucleus with at least two organic nuclei, wherein at least one of the multivalent organic nucleus and the organic nuclei is a multicyclic aromatic nucleus; or b) having a phenylindane moiety.

By use of the stabilizers of the invention, dye crystallization is inhibited and sensitometric changes upon keeping are minimized.

In a preferred embodiment of the invention, the stabilizer is present at a concentration of from about 5 to about 25% by weight of the dye layer.

In another preferred embodiment of the invention, each compound of the mixture has the structure:

$$(R^1Y^1)_p[(Z^1Y^2)_mR^2Y^3]_nZ^2Y^4R^3$$

wherein:

m is 0 or 1;

n is the number of recurring units in the compound, and is 0 up to, but not including, an integer at which said compound starts to become a polymer;

p is an integer of from 1 to 8;

$R^1$ and $R^3$ each independently represents a monovalent aliphatic or cycloaliphatic hydrocarbon group having from 1 to about 20 carbon atoms, or an aromatic group;

$R^2$, $Z^1$ and $Z^2$ each independently represents a multivalent aliphatic or cycloaliphatic hydrocarbon group having from 1 to about 20 carbon atoms, or an aromatic group;

$Y^1$, $Y^2$, $Y^3$ and $Y^4$ each independently represents a linking group;

with the proviso that at least one of $R^1$, $Z^1$, $R^2$, $Z^2$ and $R^3$ is a multicyclic aromatic nucleus.

Examples of a linking group for $Y^1$, $Y^2$, $Y^3$ and $Y^4$ include ester, amide, imide, urethane, nitrilomethyl, eneoxy, nitrilomethyleneimino, nitrilomethylenethio, etc.

In the above formula, the expression $[(Z^1Y^2]_n$ describes nonpolymeric compounds which are oligomers. Oligomers are usually formed when either $Z^1$ or $R^2$ are at least bivalent. The $(Z^1Y^2)_m$ moiety describes oligomers in which $Z^1$ repeats itself such as when $Z^1$ is derived from p-hydroxybenzoic acid. When n is 1 or more, p in the structural formula is preferably 1 to avoid significant crosslinking of the compound due to the multivalent nature of $Z^1$.

A "multicyclic aromatic nucleus" is a nucleus comprising at least two cyclic groups, one of which is aromatic, including aromatic heterocyclic ring groups. The cyclic group may be substituted with substituents such as aliphatic hydrocarbons, including cycloaliphatic hydrocarbons, other aromatic ring groups such as aryl and heterocyclic ring groups such as substituted or fused thiazole, oxazole, imide, pyrazole, triazole, oxadiazole, pyridine, pyrimidine, pyrazine, triazine, tetrazine and quinoline groups. The substituents are fused or non-fused and mono- or polycyclic. Examples of multicyclic aromatic nuclei include 9,9-bis(4-hydroxy-3,5-dichlorophenyl)-fluorene; 4,4'-hexahydro-4,7-methanoindan-5-ylidenebis(2,6-dichlorophenol); 9,9-bis(4-hydroxy-3,5-dibromophenyl)-fluorene; 4,4'-hexahydro-4,7-methanoindan-5-ylidenebis(2,6-dibromo-phenol); 3',3'',5',5''-tetrabromophenolphthalein; 9,9-bis(4-aminophenyl)fluorene; phenylindandiols; 1,1'-spirobiindandiols; 1,1'-spirobiindandiamines; 2,2-spirobichromans; 7,7-dimethyl-7H-dibenzo[c,h]xanthenediol; xanthylium salt diols; 9,9-dimethylxanthene-3,6-bis(oxyacetic acids); 4,4'(3-phenyl-1-indanylidene)-diphenols and other bisphenols; 3,3'-dibromo-5'5''-dinitro-2'2''-oxaphenol-phthalein; 9-phenyl-3-oxo-2,6,7-trihydroxyxanthene; and the like.

"Aliphatic hydrocarbon group" refers to monovalent or divalent, alkanes, alkenes, alkadienes and alkynes having from 1 to about 20 carbon atoms. The groups are straight or branched chain and include carbohydrate, carboxylic acid, alcohol, ether, aldehyde and ketone functions. "Cycloaliphatic" refers to cyclic aliphatic hydrocarbon groups. The groups may be substituted with halogen, alkoxy, amide, nitro, esters and aromatic groups.

Exemplary aliphatic groups include methyl, ethyl, propyl, isopropyl, butyl, hexyl, 2-ethylhexyl, methoxyethyl. ethoxycarbonylpropyl, 3-oxobutyl, 3-thiapentyl, furfuryl, 2-thiazolylmethyl, cyclohexylmethyl, benzyl, phenethyl, phenoxyethyl, vinyl (—CH=CH—), 2-methylvinyl, allyl, allylidene, butadienyl, butenylidene, propargyl, etc.

"Aromatic" and "aromatic heterocyclic" group refers to organic groups which undergo the same type of substitution reaction as benzene. In benzene, substitution reactions are preferred over addition reactions. Such groups preferably have from 6 to about 40 nuclear atoms and are mono- and polycyclic.

Exemplary aromatic groups include quinolinyl, pyrimidinyl, pyridyl, phenyl, tolyl, xylyl, naphthyl, anthryl, triptycenyl, p-chlorophenyl, p-nitrophenyl, p-bromophenyl, 2,4-dichlorophenyl, 2-chlorophenyl, 3,5-dinitrophenyl, p-(tetrabromophthalimido)phenyl, p-(tetra-chlorophthalimido)phenyl; p-(tetraphenylphthalimido)phenyl, p-naphthalimidophenyl, p-(4-nitrophthalimido)phenyl, p-phthalimidophenyl, 1-hydroxy-2-naphthyl, 3,5-dibromo-4-(4-bromobenzoyloxy)phenyl, 3,5-dibromo-4-(3,5-dinitro-benzoyloxy)phenyl; 3,5-dibromo-4-(1-naphthoyloxy)phenyl, thiazolyl, oxazolyl, imidazolyl, pyrazolyl, triazolyl, oxadiazolyl, pyrazinyl, etc. and their corresponding multivalent and fused ring configurations.

In another preferred embodiment of the invention, the stabilizer having a phenylindane moiety has the formula:

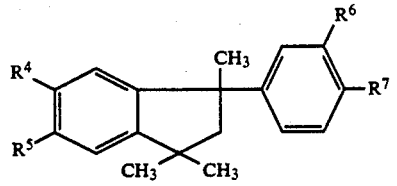

wherein $R^4$, $R^5$, $R^6$ and $R^7$ can each individually be H, COOH, —CONH—R, or —NHCO—R, where R is a substituted or unsubstituted benzene ring; or $R^4$ and $R^5$ can be taken together to form an imide moiety and $R^6$ and $R^7$ can be taken together to form an imide moiety.

In another preferred embodiment, $R^5$ and $R^6$ are each H, and $R^4$ and $R^7$ are both either —CONH—R or —NHCO—R. In still another preferred embodiment, $R^4$, $R^5$, $R^6$ and $R^7$ are all either —CONH—R or —NHCO—R.

In yet still another preferred embodiment of the invention, the stabilizer has the formula:

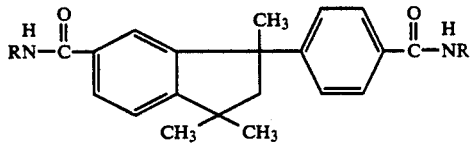

wherein R is a substituted or unsubstituted benzene ring.

For methods of making the above organic materials, reference is made to U.S. Pat. No. 4,499,165, the disclosure of which is hereby incorporated by reference. As noted above, the stabilizers of the invention have a glass transition temperature of greater than about 60° C. In a preferred embodiment, the stabilizers of the invention have a glass transition temperature of greater than about 100° C.

Specific examples of the organic materials which may be used as the stabilizers in the invention are as follows:

G 1

This is derived from the following reactants in a 3:1:2:6 ratio, $T_g$ 129° C.:

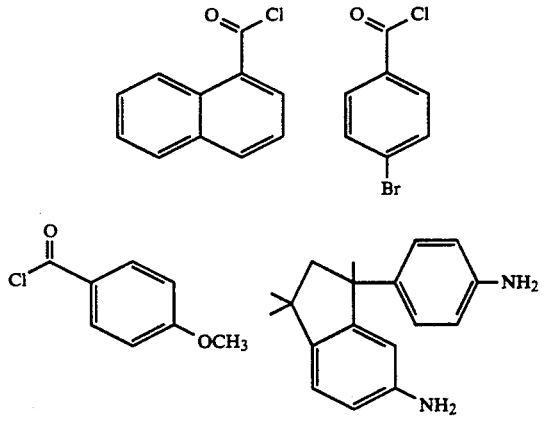

G 2

This is derived from the following reactants in a 7:6:7:20 ratio, $T_g$ 130° C.:

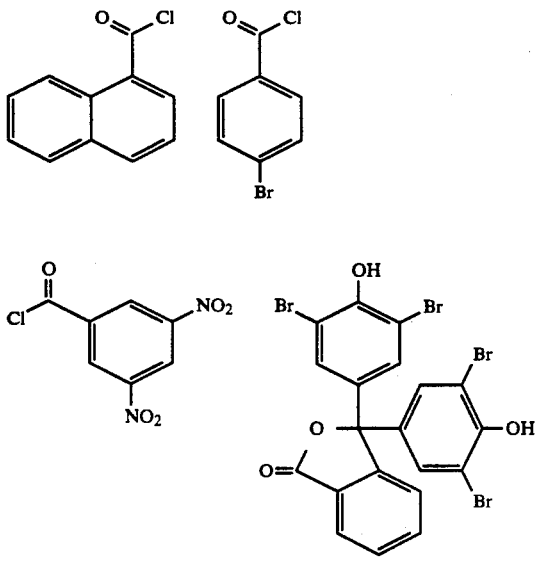
G-3 $T_g$ 124° C.:
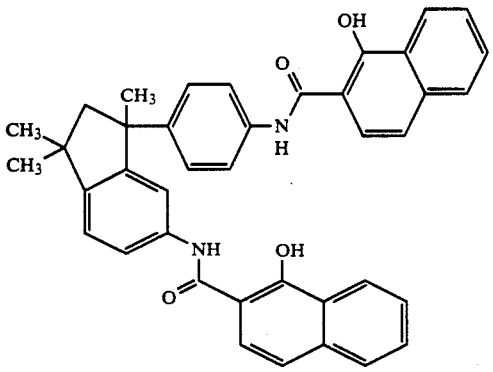
G-4 $T_g$ 129° C.:
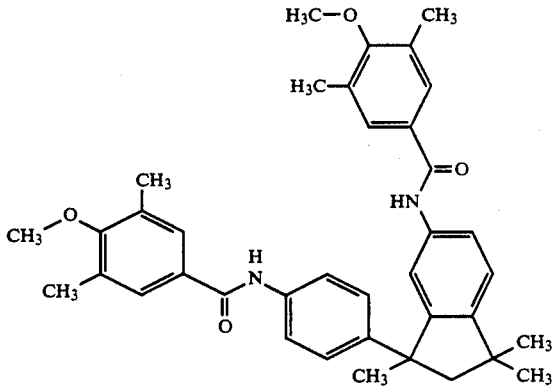
G-5 $T_g$ 124° C.:
-continued
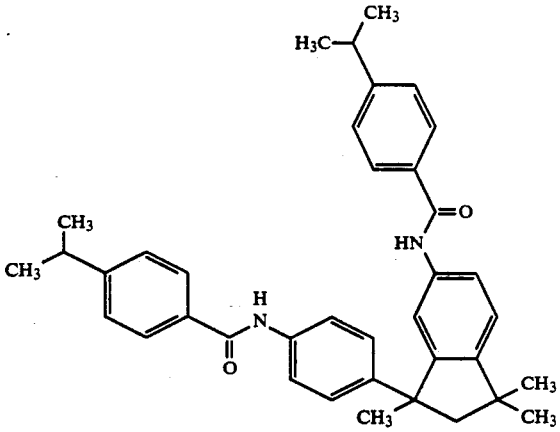
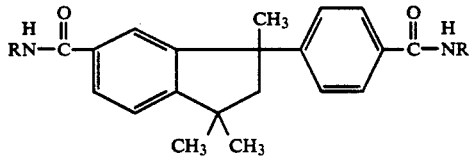
| Stabilizer | $T_g$ °C. | R |
|---|---|---|
| G-6 | 159 | 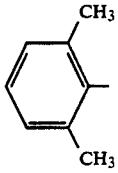 |
| G-7 | 111 | 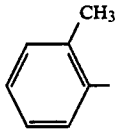 |
| G-8 | 110 | 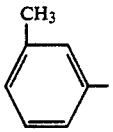 |
| G-9 | 125 | 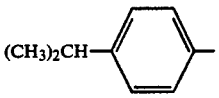 |
| G-10 | 83 | 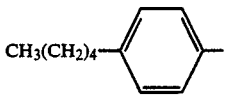 |
| G-11 | 122 | 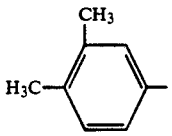 |
| G-12 | 146 | 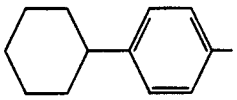 |

-continued

| | | |
|---|---|---|
| G-13 | 83 | 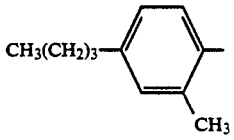 |
| G-14 | 79 | 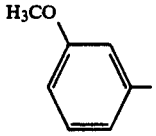 |
| G-15 | 107 | 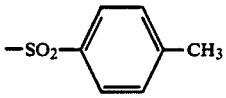 |
| G-16 | 118 | 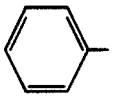 |
| G-17 | 156 | 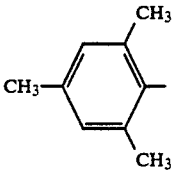 |
| G-18 | 111 | 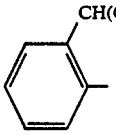 |

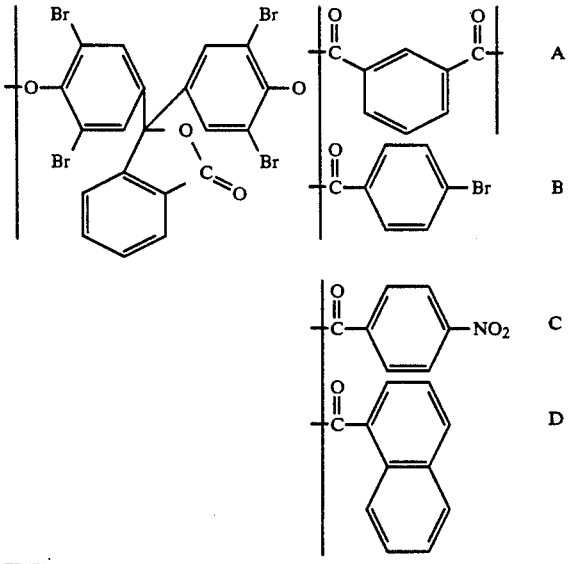

| Stabilizer | Stoichiometric Ratios A | B | C | D | MW | $T_g$, °C. |
|---|---|---|---|---|---|---|
| G-19 | 0.000 | 0.125 | 0.125 | 0.125 | 446 | 130 |
| G-20 | 0.047 | 0.094 | 0.094 | 0.094 | 929 | 158 |
| G-21 | 0.93 | 0.063 | 0.063 | 0.063 | 2035 | 188 |

G-22

-continued

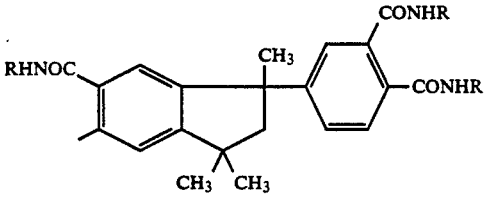

wherein R is as in G-6 to G-18 above,

G-23

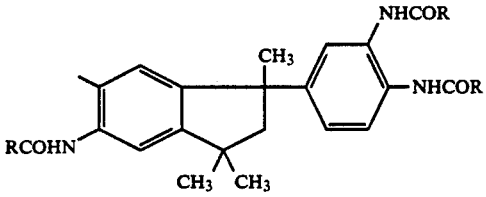

wherein R is as in G-6 to G-18 above,

G-24

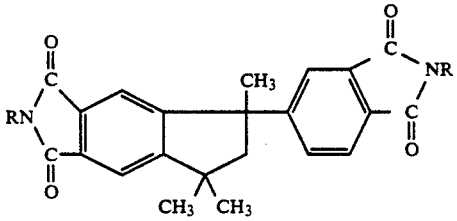

wherein R is as in G-6 to G-18 above.

Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogays Chemical Co., Ltd.);

M-1

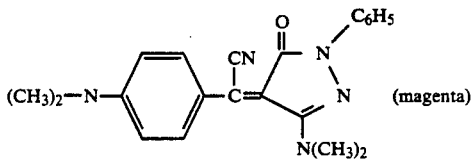

(magenta)

-continued

M-2

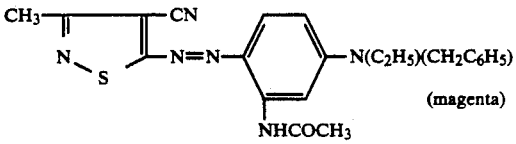

M-3

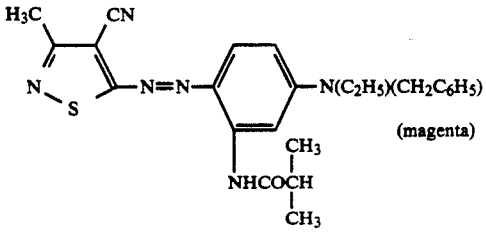

M-4

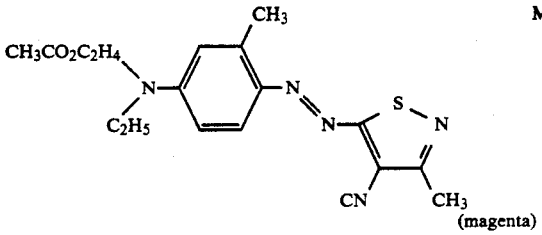

C-1

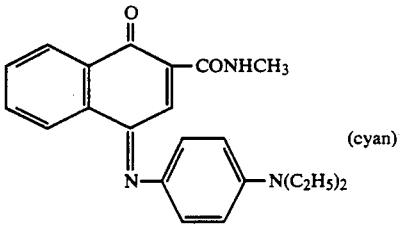

C-2

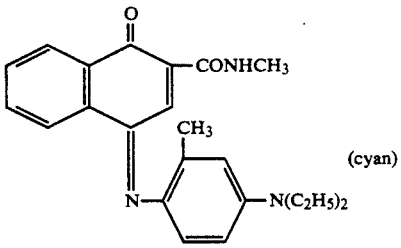

C-3

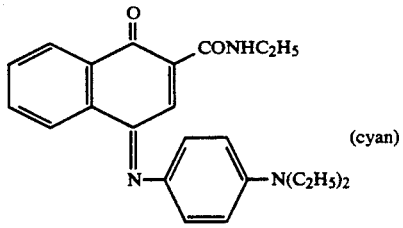

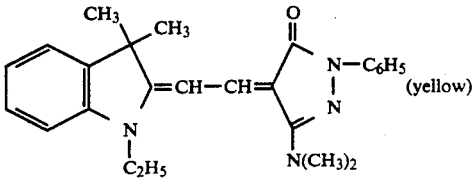

-continued

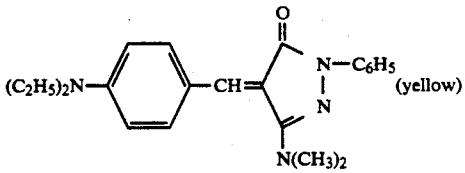

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

Any material can be used as the support for the dye-donor element of the invention provided it is dimensionally stable and can withstand the heat of the thermal head. Such materials include polyesters such as poly(ethylene terephthalate); polyamides; polydarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semicrystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have alternating areas of dyes such as sublimable cyan and/or magenta and/or yellow and/or black or other dyes. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and magenta, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A control cyan dye donor 1 was prepared by coating 0.12 g/:m$^2$ Tyzor TBT® titanium tetrabutoxide (DuPont Corp.) in a propyl acetate/butanol solvent mixture on both sides of a 6 μm poly(ethylene terephthalate) support.

On one side of the support was coated a slipping layer of 0.53 g/m$^2$ cellulose acetate propionate (CAP) binder (2.5% acetyl, 45% propionyl), 0.032 g/m$^2$ montan wax (fine particle dispersion), 0.011 g/m$^2$ PS513 aminopropyl-terminated polydimethylsiloxane (Petrarch Systems Inc.) and 0.0003 g/m$^2$ p-toluenesulfonic acid coated from a toluene/methanol/cyclopentanone mixture.

On the reverse side of the support was coated cyan dye C-1 illustrated above, (0.38 g/m$^2$), cyan dye C-2 illustrated above (0.11 g/m$^2$), CAP binder (2.5% acetyl, 45% propionyl) (0.34 g/m$^2$), S363NI micronized blend of polyethylene, polypropylene, and oxidized polyethylene particles (Shamrock Technologies, Inc.), (0.02 g/m$^2$), and Flourad® FC 430 surfactant (3M Corp.) (0.002 g/m$^2$) dissolved in and coated from a toluene/-methanol/cyclopentanone mixture.

Another control dye-donor 2 was prepared similar to control dye-donor 1 except that 0.086 g/m$^2$ of diphenyl phthalate was added to the dye layer and the CAP was adjusted to 0.26 g/m$^2$ in order to achieve equivalent sensitometric response.

Dye-donors according to the invention were prepared similar to control dye-donor 2 except that they contained the stabilizers as listed in Table 1.

A dye receiver was prepared on a support consisting of a titanium dioxide-pigmented polyethylene-overcoated paper stock subbed with poly(acrylonitrile-co-vinylidene chloride-co-acrylic acid) at 0.08 g/m$^2$ from methyl ethyl ketone solution. A dye receiving layer of Makrolon® 5700 bisphenol A polycarbonate (Bayer AG) at 1.614 g/m$^2$, a random copolymer of 4,4'-isopropylidene-bisphenol-co-2,2'-oxydiethanol polycarbonate (50:50) at 1.614 g/m$^2$, dibutyl phthalate at 0.323 g/m$^2$, diphenyl phthalate at 0.323 g/m$^2$ and FC431® fluorosurfactant (3M Corporation) at 0.011 g/m$^2$ was then coated from dichloromethane solvent. On top of this layer was applied a receiver overcoat of the above random copolymer polycarbonate at 0.215 g/m$^2$, FC431® fluorosurfactant at 0.016 g/m$^2$ and DC510® silicone surfactant (Dow Corning Corporation) at 0.008 g/m$^2$, coated from dichloromethane solvent.

Accelerated keeping tests were performed by winding samples of the donors on plastic cores and placing them (sealed at 40% RH in a foil-lined bag) into accelerated keeping ovens at 60° C. for 3 days. The incubated donors were examined under the microscope at 155× magnification for the severity of dye crystallization (0=no crystals observed, 5=essentially complete crystallization). The results are listed in Table 1.

Eleven step sensitometric images were printed using incubated and room-kept donor samples. The dye side of a dye-donor element strip approximately 10 cm× 13 cm in area was placed in contact with the dye image-receiving layer of the dye-receiver element of the same area. The assemblage was clamped to a stepper-motor driven 60 mm diameter rubber roller, and a TDK Thermal Head (No. L-231) (thermostatted at 26° C.) was pressed with a force of 36 Newtons (8 pounds) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 9 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot. The changes with incubation of Status A Red density at step 4 are listed in Table 1 as follows:

TABLE 1

| | Image Density and Crystallization | | | |
|---|---|---|---|---|
| | Step 4 Red Density | | | |
| Stabilizer | Before Incub. | After Incub. | Difference | Crystals |
| none Control 1 | 0.51 | 0.66 | 0.15 | 3 |
| G-1 | 0.65 | 0.59 | −0.06 | 3 |
| G-3 | 0.64 | 0.58 | −0.06 | 1.5 |
| G-6 | 0.50 | 0.51 | 0.01 | 1 |
| G-7 | 0.52 | 0.55 | 0.03 | 2 |
| G-8 | 0.57 | 0.60 | 0.03 | 2.5 |
| G-9 | 0.59 | 0.61 | 0.02 | 3 |
| G-11 | 0.55 | 0.55 | 0.00 | 3 |
| diphenyl phthalate (Control 2) | 0.77 | 0.55 | −0.22 | 5 |

The above data show that all stabilizers of the invention led to a decrease in the sensitometric change relative to the controls. Moreover all stabilizers of the invention were equivalent or better in respect to the observed extent of crystallization. Diphenyl phthalate, Control 2, is a normal low-$T_g$ organic compound which gave rise to an extensive sensitometric change and severe crystallization.

EXAMPLE 2

Donor with two different stabilizers admixed in a magenta dye layer

A control magenta dye-donor was prepared similar to control 1 cyan dye donor above except that the dye layer contained magenta dye M-1 illustrated above (0.15 g/m$^2$), magenta dye M-2 illustrated above (0.14 g/m$^2$), the S363NI was present at 0.01 g/m$^2$), and the Fluorad ® FC 430 surfactant was present at 0.02 g/m$^2$.

Magenta dye-donors according to the invention were prepared similar to the control except that they contained the stabilizers identified below in Table 2 in an amount of 0.09 g/m$^2$.

These donors were tested as in Example 1 with the following results:

TABLE 2

| | Image Density and Crystallization | | | |
|---|---|---|---|---|
| | Step 4 Green Density | | | |
| Stabilizer | Before Incub. | After Incub. | Difference | Crystals |
| none (Control) | 0.39 | 0.46 | 0.07 | 2.5 |
| G-6 | 0.41 | 0.47 | 0.06 | 0 |
| G-12 | 0.44 | 0.52 | 0.08 | 0 |

The above data show the effectiveness of the stabilizers of the invention when used in a magenta dye mixture. The small sensitometric change on incubation noted with the control was not affected by the stabilizers. However, dye crystallization was eliminated by addition of the stabilizers.

EXAMPLE 3

Donor with varying levels of G-1 admixed in a cyan layer

Example 1 was repeated using G-1 in the amounts listed in the table below. The following results were obtained:

TABLE 3

| | Image Density and Crystallization | | | |
|---|---|---|---|---|
| | Step 4 Red Density | | | |
| Stabilizer G-1 (g/m$^2$) | Before Incub. | After Incub. | Difference | Crystals |
| none (Control) | 0.48 | 0.63 | 0.15 | 3.5 |
| 0.04 | 0.53 | 0.60 | 0.07 | 3 |
| 0.09 | 0.52 | 0.54 | 0.02 | 2 |
| 0.13 | 0.54 | 0.55 | 0.01 | 1.5 |
| 0.17 | 0.56 | 0.58 | 0.02 | 1 |

The above results show the effects of stabilizer concentration on sensitometric change and crystallization. These changes due to incubation were minimized as the stabilizer concentration was increased.

EXAMPLE 4

Donor with Different Binders

In this Example, the cyan dye mixture of Example 1 was used, but with Butvar B76® poly(vinyl alcohol-co-butyral) with approximately 10% alcohol content, (Monsanto Co.) (0.35 g/m$^2$) and ethyl cellulose (EC) (0.30 g/m$^2$). The following results were obtained:

TABLE 4

| Effect of Different Binders in Donor Dye Layer Image Density and Crystallization | | | | | |
|---|---|---|---|---|---|
| | | Step 4 Red Density | | | |
| Binder | Stabilizer | Before Incub. | After Incub. | Difference | Crystals |
| EC | none | 0.85 | 0.80 | −0.05 | 3 |
| Butvar | none | 0.55 | 0.54 | −0.01 | 3.5 |
| EC | G-1 | * | * | * | 0 |
| Butvar | G-1 | 0.47 | 0.51 | 0.04 | 1 |

*No data collected because donor stuck to receiver.

Table 4 shows that G-1 was effective in binder systems other than CAP. Although sensitometric changes were small when ethyl cellulose or poly(vinyl butyral) binders were used, the substantial crystallization observed with the controls were dramatically reduced with addition of stabilizer G-1.

EXAMPLE 5

Donor with additional stabilizers admixed in a cyan layer

Example 1 was repeated using the stabilizers indicated in Table 5 below at 0.11 g/m². The CAP was adjusted to 0.24 g/m². The following results were obtained:

TABLE 5

| | Image Density and Crystallization | | | |
|---|---|---|---|---|
| | Step 4 Red Density | | | |
| Stabilizer | Before Incub. | After Incub. | Difference | Crystals |
| none Control 1 | 0.50 | 0.69 | 0.19 | 3.5 |
| G-1 | 0.57 | 0.57 | 0.00 | 2.5 |
| G-3 | 0.66 | 0.63 | −0.03 | 1.5 |
| G-5 | 0.61 | 0.67 | 0.06 | 2.5 |
| G-4 | 0.58 | 0.57 | −0.01 | 2.5 |
| G-12 | 0.58 | 0.62 | 0.04 | 3 |
| G-6 | 0.49 | 0.48 | −0.01 | 2 |
| G-14 | 0.58 | 0.57 | −0.01 | 3 |

The above results indicate that use of a variety of stabilizers of the invention was beneficial in regard to sensitometric changes and degree of crystallization.

EXAMPLE 6

Donor with other types of stabilizers admixed in a cyan layer

Example 1 was repeated using the stabilizers indicated in Table 6 below. The following results were obtained:

TABLE 6

| | Image Density and Crystallization | | | |
|---|---|---|---|---|
| | Step 4 Red Density | | | |
| Stabilizer | Before Incub. | After Incub. | Difference | Crystals |
| none Control 1 | 0.39 | 0.47 | 0.08 | 3 |
| G-1 | 0.40 | 0.40 | 0.00 | 1 |
| G-5 | 0.45 | 0.42 | −0.03 | 2.5 |
| G-20 | 0.43 | 0.43 | 0.00 | 1.5 |
| G-19 | 0.45 | 0.41 | −0.04 | 1.5 |
| G-21 | 0.43 | 0.45 | 0.02 | 1 |
| G-15 | 0.38 | 0.36 | −0.02 | 1 |

The above results indicate that use of a variety of stabilizers of the invention was beneficial in regard to sensitometric changes and degree of crystallization.

EXAMPLE 7

Effects of additional stabilizers with a different cyan mixture

Example 1 was repeated using the stabilizers indicated in Table 7 below, except that the donor slipping layer contained 0.48 g/m² poly(vinyl acetal), 0.01 g/m² PS513, and 0.008 g/m² BYK S732 (a copolymer of poly(propylene oxide) and poly(methyl octyl siloxane) available from BYK Chemie USA) and the drier temperature was 60° C. compared to 82° C. in all other Examples.

The cyan dye mixture of Example 1 was coated onto the substrate side opposite the above slipping layer and again used as control for one set of tests (control 1). In a second set of tests, a mixture of cyan dye C-3 (0.39 g/m²) and C-2 (0.11 g/m²) was used as control 2. Both controls were compared to stabilizer G-1 and G-17 at 0.06 g/m² and the CAP was present at 0.31 g/m². The following results were obtained:

TABLE 7

| | Image Density and Crystallization | | | |
|---|---|---|---|---|
| | Step 4 Red Density | | | |
| Stabilizer | before | after | difference | crystals |
| none-control 1 | 0.47 | 0.83 | 0.36 | 2.5 |
| G-1 | 0.46 | 0.55 | 0.09 | 1 |
| G-17 | 0.44 | 0.55 | 0.11 | 0 |
| none-control 2 | 0.51 | 1.08 | 0.57 | 0 |
| G-1 | 0.50 | 0.67 | 0.17 | 0 |
| G-17 | 0.48 | 0.70 | 0.22 | 0 |

The above results again indicate that use of a variety of stabilizers of the invention was beneficial in regard to sensitometric changes and degree of crystallization.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having thereon a dye layer comprising an image dye in a polymeric binder, the improvement wherein said dye layer also contains a stabilizer comprising a monomeric or oligomeric organic material having a glass transition temperature of greater than about 60° C., said stabilizer:

a) being derived from a mixture of at least two different compounds, each having at least two linking components joining one multivalent organic nucleus with at least two organic nuclei, wherein at least one of the multivalent organic nucleus and the organic nuclei is a multicyclic aromatic nucleus; or b) having a phenylindane moiety.

2. The element of claim 1 wherein said stabilizer is present at a concentration of from about 5 to about 25% by weight of said dye layer.

3. The element of claim 1 wherein each compound of said mixture has the structure:

$$(R^1Y^1)_p[(Z^1Y^2)_mR^2Y^3]_nZ^2Y^4R^3$$

wherein:

m is 0 or 1;

n is the number of recurring units in the compound, and is 0 up to, but not including, an integer at which said compound starts to become a polymer;

p is an integer of from 1 to 8;

$R^1$ and $R^3$ each independently represents a monovalent aliphatic or cycloaliphatic hydrocarbon group having from 1 to about 20 carbon atoms, or an aromatic group;

$R^2$, $Z^1$ and $Z^2$ each independently represents a multivalent aliphatic or cycloaliphatic hydrocarbon group having from 1 to about 20 carbon atoms, or an aromatic group;

$Y^1$, $Y^2$, $Y^3$ and $Y^4$ each independently represents a linking group;

with the proviso that at least one of $R^1$, $Z^1$, $R^2$, $Z^2$ and $R^3$ is a multicyclic aromatic nucleus.

4. The element of claim 1 wherein said stabilizer having a phenylindane moiety has the formula:

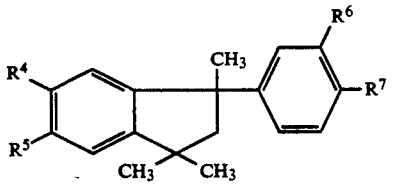

wherein $R^4$, $R^5$, $R^6$ and $R^7$ can each individually be H, COOH, —CONH—R, or —NHCO—R, where R is a substituted or unsubstituted benzene ring; or $R^4$ and $R^5$ can be taken together to form an imide moiety and $R^6$ and $R^7$ can be taken together to form an imide moiety.

5. The element of claim 4 wherein $R^5$ and $R^6$ are each H, and $R^4$ and $R^7$ are both either —CONH—R or —NHCO—R.

6. The element of claim 4 wherein $R^4$, $R^5$, $R^6$ and $R^7$ are all either —CONH—R or —NHCO—R.

7. The element of claim 4 wherein said stabilizer having a phenylindane moiety has the formula:

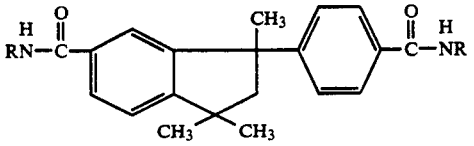

wherein R is a substituted or unsubstituted benzene ring.

8. In a process of forming a thermal dye transfer image comprising:

I) contacting at least one dye-donor element comprising a support having thereon a dye layer comprising an image dye in a polymeric binder, with a dye-receiving element comprising a support having thereon a polymeric dye image-receiving layer;

II) imagewise-heating said dye-donor element; and

III) transferring a dye image to said dye-receiving element to form said thermal dye transfer image, the improvement wherein said dye layer also contains a stabilizer comprising a monomeric or oligomeric organic material having a glass transition temperature of greater than about 60° C., said stabilizer:

a) being derived from a mixture of at least two different compounds, each having at least two linking components joining one multivalent organic nucleus with at least two organic nuclei, wherein at least one of the multivalent organic nucleus and the organic nuclei is a multicyclic aromatic nucleus; or b) having a phenylindane moiety.

9. The process of claim 8 wherein said stabilizer is present at a concentration of from about 5 to about 25% by weight of said dye layer.

10. The process of claim 8 wherein each compound of said mixture has the structure:

$$(R^1Y^1)_p[(Z^1Y^2)_mR^2Y^3]_nZ^2Y^4R^3$$

wherein:

m is 0 or 1;

n is the number of recurring units in the compound, and is 0 up to, but not including, an integer at which said compound starts to become a polymer;

p is an integer of from 1 to 8;

$R^1$ and $R^3$ each independently represents a monovalent aliphatic or cycloaliphatic hydrocarbon group having from 1 to about 20 carbon atoms, or an aromatic group;

$R^2$, $Z^1$ and $Z^2$ each independently represents a multivalent aliphatic or cycloaliphatic hydrocarbon group having from 1 to about 20 carbon atoms, or an aromatic group;

$Y^1$, $Y^2$, $Y^3$ and $Y^4$ each independently represents a linking group;

with the proviso that at least one of $R^1$, $Z^1$, $R^2$, $Z^2$ and $R^3$ is a multicyclic aromatic nucleus.

11. The process of claim 8 wherein said stabilizer having a phenylindane moiety has the formula:

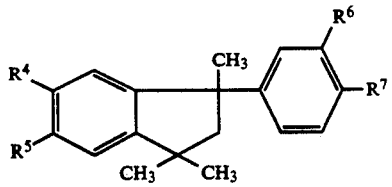

wherein $R^4$, $R^5$, $R^6$ and $R^7$ can each individually be H, COOH, —CONH—R, or —NHCO—R, where R is a substituted or unsubstituted benzene ring; or $R^4$ and $R^5$ can be taken together to form an imide moiety and $R^6$ and $R^7$ can be taken together to form an imide moiety.

12. The process of claim 11 wherein $R^5$ and $R^6$ are each H, and $R^4$ and $R^7$ are both either —CONH—R or —NHCO—R.

13. The process of claim 11 wherein $R^4$, $R^5$, $R^6$ and $R^7$ are all either —CONH—R or —NHCO—R.

14. The process of claim 11 wherein said stabilizer having a phenylindane moiety has the formula:

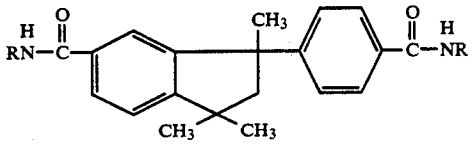

wherein R is a substituted or unsubstituted benzene ring.

15. In a thermal dye transfer assemblage comprising:

(I) a dye donor element comprising a support having thereon a dye layer comprising an image dye dispersed in a polymeric binder, and (II) a dye-receiving element comprising a support having thereon a dye image-receiving layer, said dye-receiving element being in superposed relationship with said dye-donor element so that said dye layer is in contact with said dye image-receiving layer, the improvement wherein said dye layer also contains a stabilizer comprising a monomeric or oligomeric organic material having a glass transition temperature of greater than about 60° C., said stabilizer:

a) being derived from a mixture of at least two different compounds, each having at least two linking components joining one multivalent organic nucleus with at least two organic nuclei, wherein at least one of the multivalent organic nucleus and the organic nuclei is a multicyclic aromatic nucleus; or b) having a phenylindane moiety.

16. The assemblage of claim 15 wherein said stabilizer is present at a concentration of from about 5 to about 25% by weight of said dye layer.

17. The assemblage of claim 15 wherein each compound of said mixture has the structure:

$$(R^1Y^1)_p[(Z^1Y^2)_mR^2Y^3]_nZ^2Y^4R^3$$

wherein:

m is 0 or 1;

n is the number of recurring units in the compound, and is 0 up to, but not including, an integer at which said compound starts to become a polymer;

p is an integer of from 1 to 8;

$R^1$ and $R^3$ each independently represents a monovalent aliphatic or cycloaliphatic hydrocarbon group having from 1 to about 20 carbon atoms, or an aromatic group;

$R^2$, $Z^1$ and $Z^2$ each independently represents a multivalent aliphatic or cycloaliphatic hydrocarbon group having from 1 to about 20 carbon atoms, or an aromatic group;

$Y^1$, $Y^2$, $Y^3$ and $Y^4$ each independently represents a linking group;

with the proviso that at least one of $R^1$, $Z^1$, $R^2$, $Z^2$ and $R^3$ is a multicyclic aromatic nucleus.

18. The assemblage of claim 15 wherein said stabilizer having a phenylindane moiety has the formula:

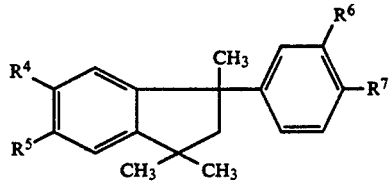

wherein $R^4$, $R^5$, $R^6$ and $R^7$ can each individually be H, COOH, —CONH—R, or —NHCO—R, where R is a substituted or unsubstituted benzene ring; or $R^4$ and $R^5$ can be taken together to form an imide moiety and $R^6$ and $R^7$ can be taken together to form an imide moiety.

19. The assemblage of claim 18 wherein $R^5$ and $R^6$ are each H, and $R^4$ and $R^7$ are both either —CONH—R or —NHCO—R; or $R^4$, $R^5$, $R^6$ and $R^7$ are all either —CONH—R or —NHCO—R.

20. The assemblage of claim 18 wherein said stabilizer having a phenylindane moiety has the formula:

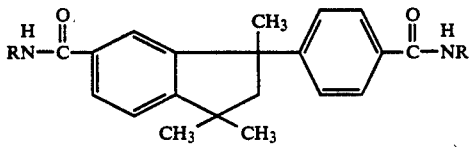

wherein R is a substituted or unsubstituted benzene ring.

* * * * *